US011319961B2

(12) United States Patent
Kono et al.

(10) Patent No.: US 11,319,961 B2
(45) Date of Patent: May 3, 2022

(54) CENTRIFUGAL BLOWER, AIR CONDITIONER, AND REFRIGERATION CYCLE APPARATUS

(71) Applicant: Mitsubishi Electric Corporation, Tokyo (JP)

(72) Inventors: Atsushi Kono, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 267 days.

(21) Appl. No.: 16/081,621

(22) PCT Filed: May 20, 2016

(86) PCT No.: PCT/JP2016/065095

§ 371 (c)(1),
(2) Date: Aug. 31, 2018

(87) PCT Pub. No.: WO2017/199444

PCT Pub. Date: Nov. 23, 2017

(65) Prior Publication Data

US 2019/0101131 A1 Apr. 4, 2019

(51) Int. Cl.
*F04D 25/16* (2006.01)
*F24F 1/00* (2019.01)
(Continued)

(52) U.S. Cl.
CPC ..... *F04D 25/166* (2013.01); *F04D 29/162* (2013.01); *F04D 29/4213* (2013.01);
(Continued)

(58) Field of Classification Search
CPC ..... F04D 29/4226; F04D 29/4213; F04D 29/162; F04D 25/166; F24F 1/0022;
(Continued)

(56) References Cited

U.S. PATENT DOCUMENTS 3,033,307 A * 5/1962 Sanders ..... F01N 1/10 181/224
3,407,995 A * 10/1968 Kinsworthy ..... F04D 17/162 415/94

(Continued)

FOREIGN PATENT DOCUMENTS

AU 6319900 A 5/2001
JP 09-126193 A 5/1994

(Continued)

OTHER PUBLICATIONS

JP 2012/211574 A, Espacenet machine translation, 2012 (Year: 2012).*

(Continued)

*Primary Examiner* — Courtney D Heinle
*Assistant Examiner* — Ryan C Clark
(74) *Attorney, Agent, or Firm* — Posz Law Group, PLC

(57) ABSTRACT

A centrifugal blower having high efficiency and reduced noise is provided. A centrifugal blower to be accommodated in a housing having an air inlet includes a spiral casing having a bell mouth and a centrifugal fan housed in the casing. The bell mouth includes a first region and a second region. The first region is disposed closest to the air inlet. A distance from a rotational axis of the centrifugal fan to a downstream end in the first region is greater than a distance from the rotational axis to the downstream end in the second region. A curvature of a surface of the first region in a cross section including the rotational axis is smaller than a curvature of a surface of the second region in a cross section including the rotational axis.

9 Claims, 8 Drawing Sheets

(51) Int. Cl.

| | |
|---|---|
| ***F04D 29/16*** | (2006.01) |
| ***F04D 29/42*** | (2006.01) |
| ***F24F 1/0022*** | (2019.01) |
| ***F24F 1/0059*** | (2019.01) |
| ***F24F 1/38*** | (2011.01) |
| ***F24F 1/40*** | (2011.01) |
| ***F24F 1/0007*** | (2019.01) |

(52) U.S. Cl.
CPC ..... *F04D 29/4226* (2013.01); *F24F 1/00* (2013.01); *F24F 1/0022* (2013.01); *F24F 1/0059* (2013.01); *F24F 1/38* (2013.01); *F05D 2250/51* (2013.01); *F24F 1/0007* (2013.01); *F24F 1/40* (2013.01)

(58) Field of Classification Search
CPC .... F24F 1/00; F24F 1/40; F24F 1/0007; F24F 1/0059; F05B 2260/96
See application file for complete search history.

(56) References Cited

U.S. PATENT DOCUMENTS

| | | | | |
|---|---|---|---|---|
| 3,824,028 | A * | 7/1974 | Zenkner | F04D 29/4226 415/58.6 |
| 5,601,400 | A | 2/1997 | Kondo et al. | |
| 6,884,033 | B2 * | 4/2005 | Liao | F04D 29/4213 257/E23.099 |
| 7,677,865 | B2 * | 3/2010 | Han | F04D 29/667 415/119 |
| 7,887,290 | B2 * | 2/2011 | Chen | F04D 29/663 415/206 |
| 8,360,718 | B2 * | 1/2013 | Dybenko | F04D 29/441 415/206 |
| 9,206,813 | B2 * | 12/2015 | Lin | F04D 25/08 |
| 9,964,118 | B2 * | 5/2018 | Park | F04D 29/403 |
| 10,024,334 | B2 * | 7/2018 | Lei | F04D 29/4226 |
| 2007/0116559 | A1 * | 5/2007 | Higashida | F24F 1/0007 415/206 |
| 2011/0002775 | A1 * | 1/2011 | Ma | F04D 29/664 415/119 |
| 2019/0389345 | A1 * | 12/2019 | Kim | F04D 17/16 |

FOREIGN PATENT DOCUMENTS

| | | | | |
|---|---|---|---|---|
| JP | 08-086299 | A | 4/1996 | |
| JP | 2000-179496 | A | 6/2000 | |
| JP | 2001-124360 | A | 5/2001 | |
| JP | 2006-097502 | A | 4/2006 | |
| JP | 2006097502 | A * | 4/2006 | F04D 29/4226 |
| JP | 2007-127089 | A | 5/2007 | |

OTHER PUBLICATIONS

JP 2007/127089 A, Espacenet machine translation, 2007 (Year: 2007).*
JP2006097502A Machine Translation (Year: 2006).*
International Search Report of the International Searching Authority dated Aug. 9, 2016 for the corresponding international application No. PCT/JP2016/065095 (and English translation).
Extended European Search Report dated May 8, 2019 for the corresponding EP application No. 16902463.5.
Office Action dated Oct. 1, 2019 issued in corresponding JP patent application No. 2018-518058 (and English translation).
Office Action dated Jan. 19, 2020 issued in corresponding CN patent application No. 201680084968.4 (and English translation).
Office Action dated Jul. 29, 2020 issued in the counterpart CN application No. 201680084968.4 (and English translation).

* cited by examiner

CENTRIFUGAL BLOWER, AIR CONDITIONER, AND REFRIGERATION CYCLE APPARATUS

CROSS REFERENCE TO RELATED APPLICATION

This application is a U.S. national stage application of PCT/JP2016/065095 filed on May 20, 2016, the contents of which are incorporated herein by reference.

TECHNICAL FIELD

The present invention relates to a centrifugal blower, and an air conditioner and a refrigeration cycle apparatus each including the centrifugal blower.

BACKGROUND ART

Centrifugal blowers for use in air conditioners or refrigeration cycle apparatuses have conventionally been known. For example, Japanese Patent Laying-Open No. 09-126193 (PTD 1) discloses a centrifugal blower including a casing and a centrifugal impeller of multi-vane centrifugal type which is held inside the casing, in which the casing has a suction port defined by a bell mouth on a side surface thereof intersecting the rotational axis of the centrifugal impeller. PTD 1 discloses a casing configured to have a distance varying locally from the rotational axis of the centrifugal impeller to the outer edge of the suction port. Specifically, the casing is configured such that the distance is relatively small in a region of −60° to +60° in the direction of rotation of the centrifugal impeller and the distance is relatively great in a region of +120° to 270° in the direction of rotation of the centrifugal impeller, where a nose (tongue) adjacent to an outlet is a starting point.

CITATION LIST

Patent Document

PTD 1: Japanese Patent Laying-Open No. 09-126193

SUMMARY OF INVENTION

Technical Problem

For example, in a conventional recessed air conditioner, the suction port of the casing of the centrifugal blower may be placed perpendicular to the air inlet formed in the housing of the air conditioner. In such a case, the air taken in from the air inlet turns 90° at the bell mouth placed at the suction port of the casing of the centrifugal blower, and subsequently flows into the centrifugal impeller from the suction port of the casing. An airflow accordingly concentrates on the bell mouth on the air inlet side. This easily leads to airflow separation particularly on the surface of the bell mouth on the air inlet side, allowing the airflow to be deviated to the main plate of a fan. Consequently, the wind speed distribution of an airflow becomes nonuniform on the vane front edge of the centrifugal impeller, leading to reduced efficiency or increased noise.

Considering the above, the centrifugal blower of PTD 1 is disposed such that the nose of the casing is located opposite to the air inlet in the housing of the air conditioner. This configuration can reduce a distance by which the air flowing from the bell mouth arrives at between the vanes of the centrifugal impeller in the casing on the air inlet side. However, the centrifugal blower disclosed in PTD 1 has little effect of preventing or reducing airflow separation on the surface of the bell mouth, and fails to sufficiently achieve an effect of improved efficiency and an effect of reduced noise.

The present invention has been made to solve the above problem, and has an object to provide a centrifugal blower having high efficiency and reduced noise, and an air conditioner and a refrigeration cycle apparatus each including the centrifugal blower.

Solution to Problem

A centrifugal blower according to the present invention is a centrifugal blower to be accommodated in a housing, and the housing has an air inlet. The centrifugal blower includes a casing and a centrifugal fan housed in the casing. The casing has a first wall facing the centrifugal fan. The first wall includes an opening for taking in air. The opening is formed in a portion of the first wall, the portion being crossed by a rotational axis of the centrifugal fan. The first wall has a bell mouth surrounding the opening. The bell mouth includes a first region and a second region. The first region is disposed closest to the air inlet. The second region is disposed farther from the first region than the air inlet is from the air inlet. The bell mouth has, in each of the first region and the second region, an end defining an outer perimeter of the opening and a surface which is curved and extends from the end to be away from the centrifugal fan. A distance from the rotational axis of the centrifugal fan to the end in the first region is greater than a distance from the rotational axis to the end in the second region. A curvature of the surface of the first region in a cross section of the first region including a central axis is smaller than a curvature of the surface of the second region in a cross section of the second region including the central axis.

Advantageous Effects of Invention

The present invention can reduce a distance by which the air flowing from the bell mouth flows into between the vanes of the centrifugal impeller and make wind speed distribution uniform on the vane front edge of the centrifugal impeller, leading to increased efficiency and reduced noise.

DESCRIPTION OF EMBODIMENTS

Figure 1:
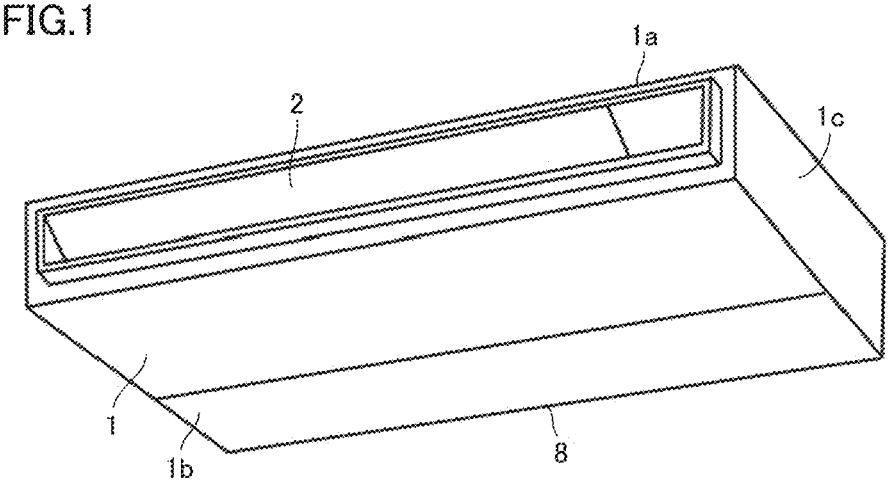
FIG. 1 is a schematic perspective view of an air conditioner according to Embodiment 1 of the present invention.

Embodiments of the present invention will be described below with reference to the drawings, in which the same or corresponding parts will be designated by the same reference numerals, and a description thereof will not be repeated.

Embodiment 1

<Configuration and Operation of Indoor Unit of Air Conditioner According to This Embodiment>

Figure 2:
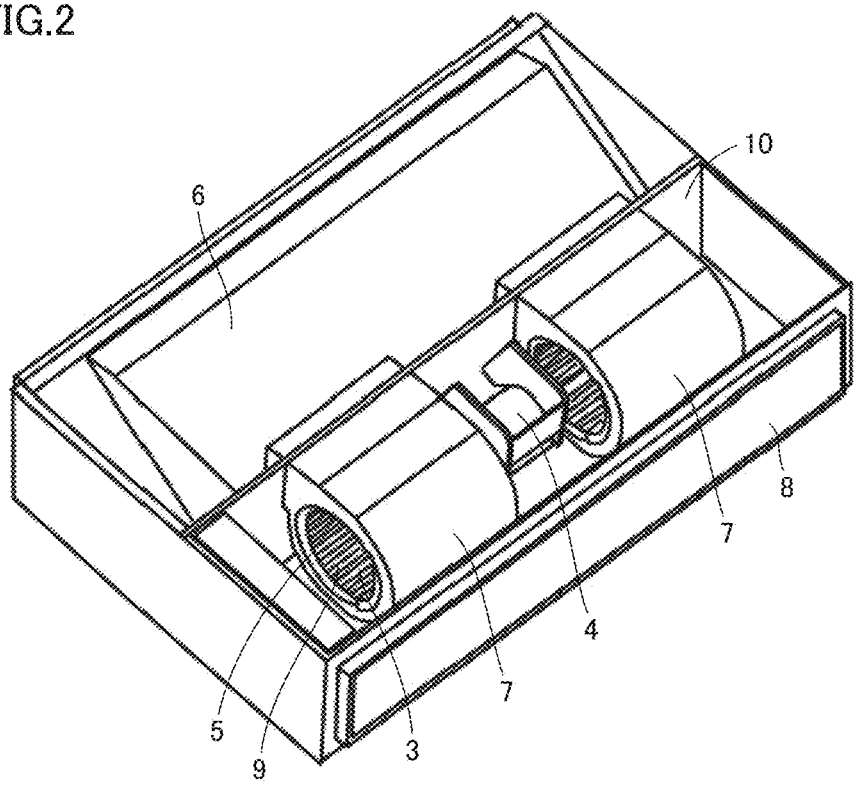
FIG. 2 is a schematic view showing an internal configuration of the air conditioner according to Embodiment 1 of the present invention.
Figure 3:
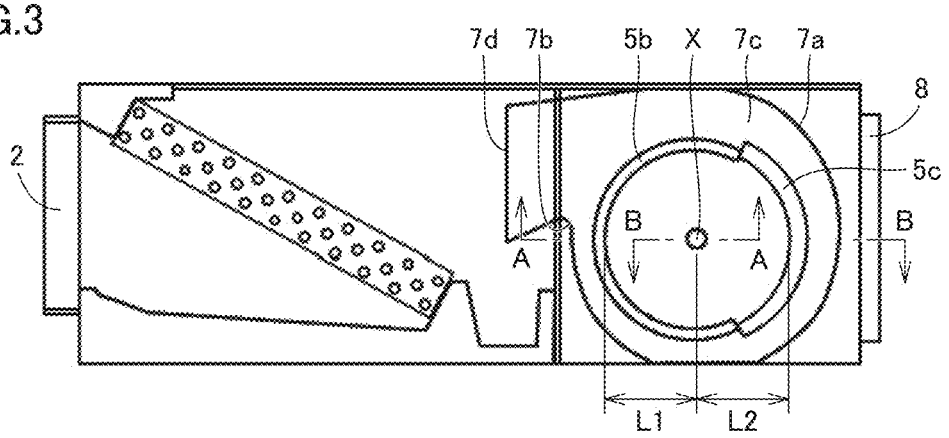
FIG. 3 is a schematic view showing the internal configuration of the air conditioner according to Embodiment 1 of the present invention, which is seen from a side surface of the air conditioner.

FIG. 1 is a schematic perspective view of an indoor unit of an air conditioner in which a centrifugal fan according to Embodiment 1 of the present invention is mounted. FIG. 2 is a schematic view showing an internal configuration of the indoor unit of the air conditioner according to Embodiment 1 of the present invention. FIG. 3 is a schematic view showing the internal configuration of the air conditioner according to Embodiment 1 of the present invention, which is seen from a side surface of the air conditioner.

As shown in FIGS. 1 to 3, the indoor unit of the air conditioner includes a housing 1 installed under the roof of a space to be subjected to air conditioning. Housing 1 can have any shape. In one example, housing 1 is formed into a rectangular parallelepiped. Housing 1 includes an upper surface portion 1*a*, a lower surface portion 1*b*, and a side surface portion 1*c*.

An air outlet 2 is provided in one surface of side surface portion 1*c* of housing 1. Air outlet 2 can have any shape. Air outlet 2 has, for example, a rectangular shape. An air inlet 8 is formed in a surface of side surface portion 1*c* of housing 1 which is opposite to the surface in which air outlet 2 is formed. Air inlet 8 can have any shape. Air inlet 8 has, for example, a rectangular shape. Air inlet 8 may be provided with a filter for removal of dust in the air.

Housing 1 accommodates a centrifugal blower in which a centrifugal fan 3 (hereinafter, also referred to as fan 3) is formed inside a spiral casing 7, a fan motor 4, and a heat exchanger 6. In the centrifugal blower, a bell mouth 5 is formed in spiral casing 7. In this embodiment, the shape of bell mouth 5 differs from that of a conventional centrifugal blower. A detailed configuration of bell mouth 5 will be described below.

A fan 3 serving as a centrifugal fan is disposed to face the opening defined by bell mouth 5. Fan motor 4 is supported by, for example, a motor support fixed to upper surface portion 1*a* of housing 1. Fan motor 4 has an output shaft extending in a rotational axis X (see FIG. 4). Rotational axis X is disposed to extend parallel to the surface of side surface portion 1*c* in which air inlet 8 is formed and the surface of side surface portion 1*c* in which air outlet 2 is formed. The output shaft is equipped with fan 3 of multi-vane centrifugal type. At least one fan 3 is attached to the output shaft. In the indoor unit shown in FIG. 2, two fans 3 are attached to the output shaft of fan motor 4. Fans 3 create a flow of air taken into housing 1 from air inlet 8 and blown out from air outlet 2 toward a target space.

Heat exchanger 6 is disposed in an air flow path inside housing 1. Specifically, heat exchanger 6 is disposed between an outlet 7*d* of the centrifugal blower and air outlet 2 as shown in FIG. 3. Heat exchanger 6 adjusts air temperature. The space in bell mouth 5 at the inlet side and the space in spiral casing 7 at the outlet side are partitioned from each other by a partition plate 10. The configuration and mode of heat exchanger 6 are not particularly limited, and a well known configuration and a well known mode are used in Embodiment 1.

When fan 3 rotates in such a configuration, the air in the room to be subjected to air conditioning is taken into air inlet 8. The air taken into housing 1 is guided by bell mouth 5 and is taken in by fan 3. Further, fan 3 blows the taken-in air radially outward of fan 3. The air blown out from fan 3 passes through spiral casing 7, and is then supplied to heat exchanger 6 from outlet 7*d* (see FIG. 3). The air supplied to heat exchanger 6 is subjected to heat exchange and humidity control while passing through heat exchanger 6. The air is subsequently blown out to the room from air outlet 2.

<Configuration of Centrifugal Blower>

Figure 4:
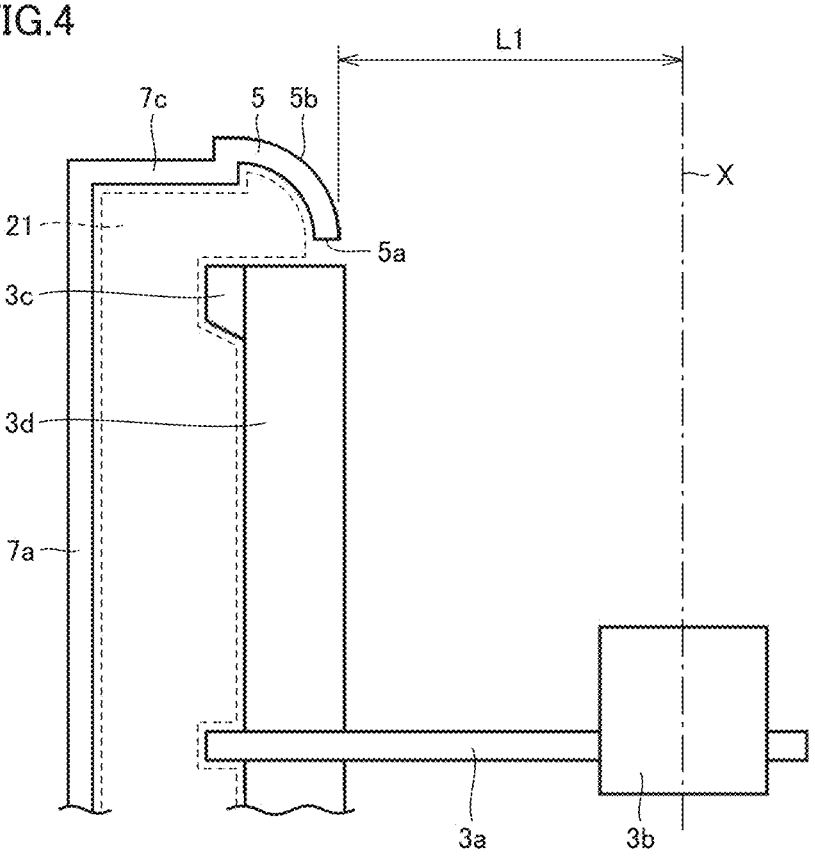
FIG. 4 is a partial schematic sectional view taken along the line segment A-A of FIG. 3.
Figure 5:
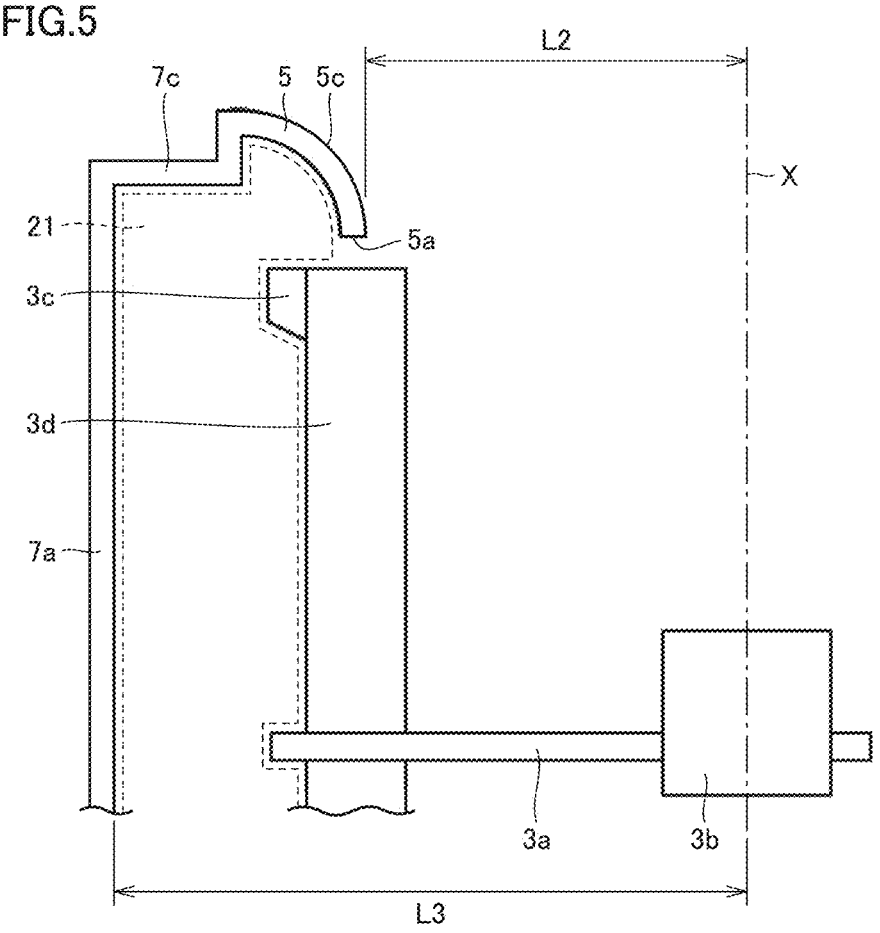
FIG. 5 is a partial schematic sectional view taken along the line segment B-B of FIG. 3.

FIG. 4 is a partial schematic sectional view taken along the line segment A-A of FIG. 3. FIG. 5 is a partial schematic sectional view taken along the line segment B-B of FIG. 3.

Fan 3 includes a main plate 3*a*, a side plate 3*c*, and a plurality of vanes 3*d*. Main plate 3*a* has a disc shape and has a boss 3*b* at its center. The center of boss 3*b* is connected with the output shaft of fan motor 4. Fan 3 is rotated by the driving force of fan motor 4 through the output shaft. Side plate 3*c* is provided opposite to main plate 3*a*. Side plate 3*c* is formed in a ring shape. Vanes 3*d* are provided to surround rotational axis X from main plate 3*a* toward side plate 3*c*. Vanes 3*d* are provided to have the same shape. Each vane 3*d* is formed of a forward curved vane in which its vane trailing edge on the outer peripheral side advances more than its vane leading edge on the inner peripheral side in the direction of rotation of fan 3.

Spiral casing 7 includes a peripheral wall 7*a* extending along the outer peripheral edge of fan 3 (see FIGS. 3 to 5). Spiral casing 7 also has a tongue 7*b* at one location of peripheral wall 7*a*. Tongue 7*b* is located forward in the direction of rotation of fan 3 as seen from outlet 7*d*. Spiral casing 7 rectifies the air blown out from fan 3. A side wall 7*c* of spiral casing 7 is provided with a suction port 9 serving as an opening of the spiral casing. Side wall 7*c* serving as a first wall facing fan 3 serving as a centrifugal fan extends in a direction crossing peripheral wall 7*a* and is formed to be continuous with peripheral wall 7*a*. Bell mouth 5 that guides an airflow to suction port 9 is formed on side wall 7*c*. From a different perspective, bell mouth 5 is disposed opposite to the suction port of fan 3. Bell mouth 5 rectifies an airflow flowing into fan 3.

Spiral casing 7 includes suction port 9 serving as an opening for taking in air into at least one side wall 7*c*. Side wall 7*c* includes bell mouth 5 having an inside diameter gradually decreasing toward downstream in the air flow direction. Surfaces 5*b* and 5*c* of bell mouth 5 are each shaped into a curved surface that projects toward rotational axis X. As shown in FIGS. 3 to 5, in bell mouth 5, a distance L2 on the air inlet 8 side (see FIG. 5) is greater than a distance L1 on the air outlet 2 side (see FIG. 4), where each of these distances is a distance from rotational axis X to a downstream end 5*a* that is the end of bell mouth 5 in a planar cross section of bell mouth 5 including rotational axis X. In the cross section, the curvature of surface 5*c* of bell mouth 5 on the air inlet 8 side is smaller than the curvature of surface 5*b* of bell mouth 5 on the air outlet 2 side (see FIGS. 3 and 4). Herein, facing side walls 7*c* maintain a uniform distance. Side wall 7*c* of spiral casing 7 and bell mouth 5*e* are connected to form a step as shown in FIGS. 4 and 5. Also, a connecting portion between surface 5*c* of bell mouth 5 which has a relatively small curvature and surface 5*b* of bell mouth 5 which has a relatively great curvature is a step.

From a different viewpoint of the configuration of the above centrifugal blower, the centrifugal blower includes spiral casing 7 serving as a casing and centrifugal fan 3 housed inside spiral casing 7. Centrifugal fan 3 includes disc-shaped main plate 3*a* having a surface, ring-shaped side plate 3*c*, and vanes 3*d*. Side plate 3*c* faces the surface of main plate 3*a*. Vanes 3*d* are disposed between main plate 3*a* and side plate 3*c* and are also connected to main plate 3*a* and side plate 3*c*. Vanes 3*d* are provided at intervals in the circumferential direction of side plate 3*c*. Spiral casing 7 includes side wall 7*c* serving as a first wall facing side plate 3*c*. The first wall (side wall 7*c*) includes an opening for taking in air. The opening is formed at a portion of side wall 7*c* which intersects the rotational axis of the centrifugal fan and at least causes the central portion of the surface of main plate 3*a* to be exposed. Side wall 7*c* has bell mouth 5 surrounding the opening. Bell mouth 5 includes a first region and a second region. The first region is disposed closest to air inlet 8. The second region is disposed farther from air inlet 8 than the first region is from air inlet 8. The bell mouth has downstream end 5*a* serving as an end defining the outer perimeter of the opening and curved surfaces 5*b* and 5*c* extending from downstream end 5*a* to be away from centrifugal fan 3 in each of the first region and the second region. Distance L2 from rotational axis X of centrifugal fan 3 to downstream end 5*a* in the first region is greater than distance L1 from rotational axis X to downstream end 5*a* in the second region. The curvature of surface 5*c* of the first region in the cross section of the first region including rotational axis X is smaller than the curvature of surface 5*b* of the second region in the cross section of the second region including rotational axis X.

The range which is located on the air inlet 8 side and has a relatively great distance from rotational axis X to bell mouth downstream end 5*a* is preferably a range as described below. Specifically, this range is preferably a range in which an angle in the circumferential direction of bell mouth 5 in the direction of rotation of fan 3 is from −90° to +90° when seen from rotational axis X, where the position of downstream end 5*a* closest to air inlet 8 is a starting point. Bell mouth downstream end 5*a* is located on the inner peripheral side of fan 3 with respect to the outer peripheral edge of fan 3 entirely in the circumferential direction of bell month 5.

On surfaces 5*b* and 5*c* of bell mouth 5, the curvatures of surfaces 5*b* and 5*c* of bell mouth 5 are preferably smaller as distances L1 and L2 from rotational axis X to downstream end 5*a* of bell mouth 5 increase in the cross section including rotational axis X.

Herein, a region of the inner space of spiral casing 7 excluding the region of rotation of fan 3 which is located on the outer peripheral side with respect to bell mouth downstream end 5*a* (see FIGS. 4 and 5) is an air duct 21 in spiral casing 7. In this case, the centrifugal blower is configured such that air duct 21 of spiral casing 7 in a plane including rotational axis X has a sectional area increasing as advancing in the direction of rotation of fan 3 starting from tongue 7*b* (see FIG. 3). Preferably, in the range having a great distance from rotational axis X to bell mouth downstream end 5*a* (the region in which surface 5*c* closer to air inlet 8 is located in bell mouth 5), the curvature of surface 5*c* of bell mouth 5 is gradually reduced or the distance from rotational axis X to peripheral wall 7*a* of spiral casing 7 is gradually reduced such that air duct 21 of spiral casing 7 has a sectional area increasing as advancing in the direction of rotation of fan 3.

The flow of air in the centrifugal blower will now be described. The air flowing from air inlet 8 turns 90° to suction port 9 of spiral casing 7 and flows thereinto. Further, the air flowing from bell mouth 5 into fan 3 turns 90° and is then flown out to be away from rotational axis X (in the centrifugal direction). This air is subsequently guided through the air duct of spiral casing 7 to be flown out of outlet 7*d* of spiral casing 7. The air is subsequently supplied to heat exchanger 6 and is subjected to heat exchange and humidity control as described above, and is subsequently blown out from air outlet 2.

<Function and Effect of Centrifugal Blower and Air Conditioner>

In the centrifugal blower used in the air conditioner, bell mouth 5 includes the first region and the second region as described above. As shown in FIGS. 3 to 5, distance L2 from rotational axis X of centrifugal fan 3 to downstream end 5*a* in the first region is greater than distance L1 from rotational axis X to downstream end 5*a* in the second region. The curvature of surface 5*c* of the first region in the cross section including rotational axis X is smaller than the curvature of surface 5*b* of the second region in the cross section including rotational axis X.

The air conditioner includes housing 1, heat exchanger 6, and the centrifugal blower described above. Housing 1 includes the first side surface and the second side surface opposite to the first side surface. Heat exchanger 6 is disposed inside housing 1. The centrifugal blower is disposed inside housing 1. Air outlet 2 is formed in the first side surface of housing 1. Air inlet 8 is formed in the second side surface of housing 1. Inside housing 1, heat exchanger 6 is disposed closer to air outlet 2 than the centrifugal blower is to air outlet 2. The first wall (side wall 7*c*) of the centrifugal blower is disposed to be extend from air inlet 8 toward air outlet 2. The first region (the portion which includes surface 5*c* with a relatively small curvature in bell mouth 5) of the centrifugal blower is disposed closer to air inlet 8 than the second region (the portion which includes surface 5*b* having a relatively great curvature in bell mouth 5) of the centrifugal blower is to air inlet 8.

The air flowing into bell mouth 5 flows while being deviated mainly from the air inlet 8 side. Consequently, the wind speed of the air is relatively high near bell mouth 5 on the air inlet 8 side, and the air flows toward rotational axis X. The present embodiment can thus increase the distance from rotational axis X to bell mouth downstream end 5*a* and increase the area of the opening (air flow path) defined by bell mouth 5 to reduce wind speed. Moreover, since the position of downstream end 5*a* of bell mouth 5 is retracted to be away from rotational axis X, the distance by which the flow of the air flowing from bell mouth 5 toward rotational axis X arrives at the leading edge of vane 3*d* can be reduced. Consequently, in the region on the air inlet 8 side, the air that has flowed into the leading edge of vane 3*d* while being deviated toward main plate 3*a* is distributed toward side plate 3*c*, making the wind speed distribution uniform on the leading edge of vane 3*d*.

Since the air flowing into the air outlet 2 side of bell mouth 5 is far from air inlet 8, the wind speed of the air is low, so that air separation from surface 5*b* of bell mouth 5 is less likely to occur on bell mouth 5. Thus, the curvature of surface 5*b* of bell mouth 5 in the cross section including rotational axis X is increased to reduce the dimension (the distance between side walls 7*c*) in the rotational axis X direction of spiral casing 7. Consequently, the area of air duct 21 in housing 1 can be increased to reduce a ventilation resistance.

Spiral casing 7 of Embodiment 1 configured as described above makes wind speed distribution uniform on the vane leading edge. The generation of a high-wind-speed region can thus be prevented or reduced, thus reducing airflow turbulence or friction loss in centrifugal fan 3. This leads to increased efficiency and decreased noise of the centrifugal blower and the air conditioner.

In the centrifugal blower, outlet 7*d* is formed in spiral-casing 7 in the radial direction perpendicular to rotational axis X as shown in FIG. 3. In spiral casing 7, the space between the inner surface of spiral casing 7 located outside centrifugal fan 3 in the radial direction and the centrifugal fan is air duct 21 (see FIGS. 4 and 5). The sectional area of air duct 21 in the cross section including rotational axis X may increase from tongue 7*b*, located forward of outlet 7*d* in spiral casing 7 in the direction of rotation of centrifugal fan 3, toward forward in the direction of rotation. This allows air to be blown out efficiently from outlet 7*d* of the centrifugal blower.

<Modification of Indoor Unit of Air Conditioner>

Figure 6:
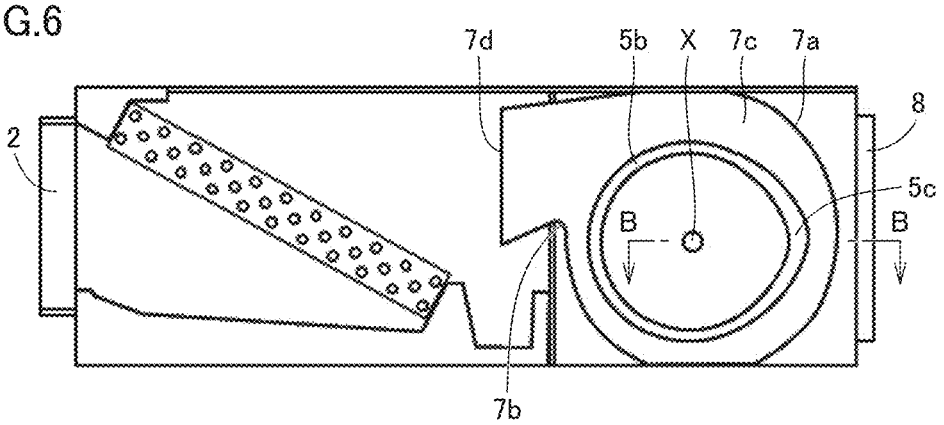
FIG. 6 is a schematic view showing an internal configuration of an air conditioner according to a modification of Embodiment 1 of the present invention, which is seen from a side surface of the air conditioner.
Figure 7:
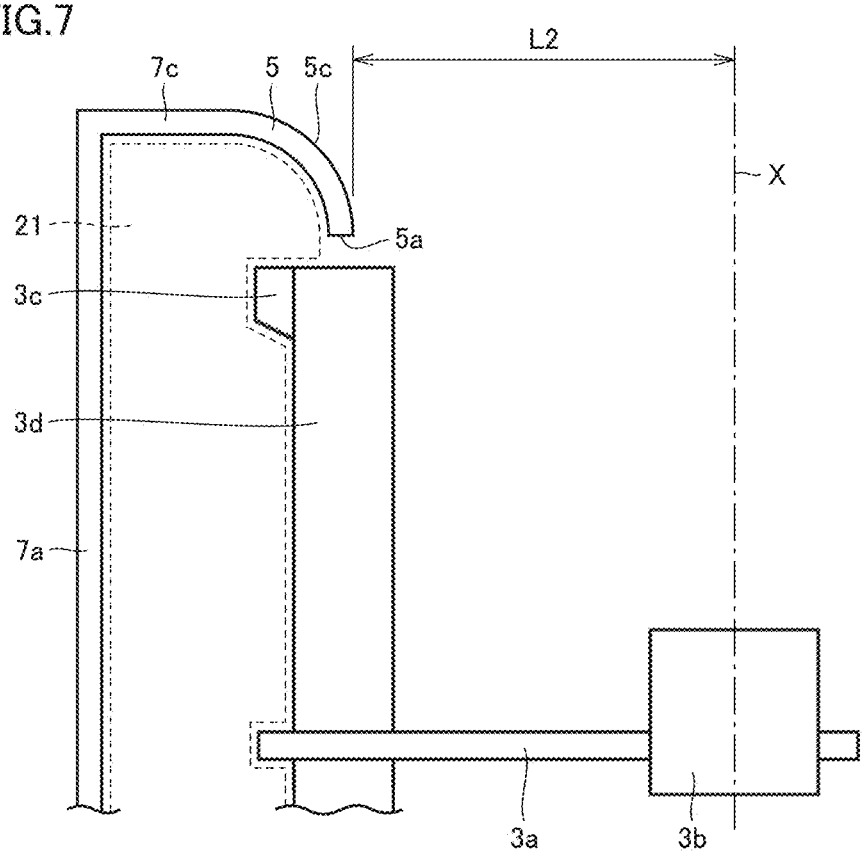
FIG. 7 is a partial schematic sectional view taken along the line segment B-B of FIG. 6.

FIG. 6 is a schematic view showing an internal configuration of an air conditioner according to a modification of Embodiment 1 of the present invention, which is seen from a side surface of the air conditioner. FIG. 7 is a partial schematic sectional view taken along the line segment B-B of FIG. 6.

The air conditioner shown in FIGS. 6 and 7 basically has a configuration similar to that of the air conditioner shown in FIGS. 1 to 5 but differs from the air conditioner shown in FIGS. 1 to 5 in the configuration of bell mouth 5 of the centrifugal blower. That is to say, in the air conditioner shown in FIGS. 6 and 7, connecting portions of side wall 7*c* and bell mouth 5 are connected by a smoothly curved surface. As shown in FIG. 6, surface 5*c* having a relatively small curvature and surface 5*b* having a relatively great curvature are connected to each other by a smoothly curved surface in the bell mouth. The distance from rotational axis X to bell mouth downstream end 5*a* is preferably greatest at a position at which bell mouth downstream end 5*a* is closest to air inlet 8, as shown in FIG. 6. The air conditioner having the above configuration can also achieve effects similar to those of the centrifugal blower and the air conditioner shown in FIGS. 1 to 5.

Embodiment 2

<Configuration of Indoor Unit of Air Conditioner According to This Embodiment>

Figure 8:
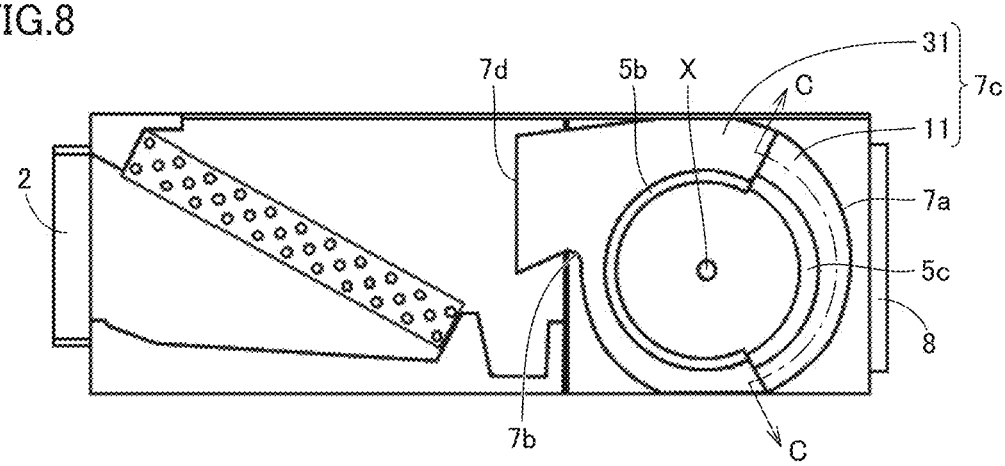
FIG. 8 is a schematic view showing an internal configuration of an air conditioner according to Embodiment 2 of the present invention, which is seen from a side surface of the air conditioner.
Figure 9:
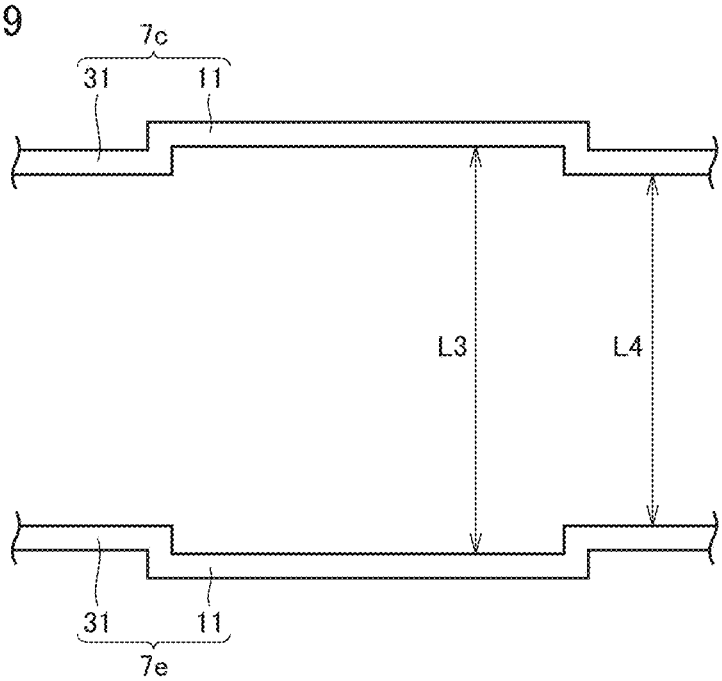
FIG. 9 is a schematic sectional view of a casing taken along the line segment C-C of FIG. 8.

FIG. 8 is a schematic view showing an internal configuration of an air conditioner according to Embodiment 2 of the present invention, which is seen from a side surface of the air conditioner. FIG. 9 is a schematic sectional view of a casing of a centrifugal blower, which is taken along the line segment C-C of FIG. 8.

The air conditioner shown in FIGS. 8 and 9 basically has a configuration similar to that of the air conditioner shown in FIGS. 1 to 5 but differs from the air conditioner shown in FIGS. 1 to 5 in the configuration of spiral casing 7 in the centrifugal blower. That is to say, a spiral casing increased portion 11 obtained by partially increasing distance L3 between facing side walls 7*c* and 7*e* of spiral casing 7 is provided in a range in which the distance from rotational axis X to downstream end 5*a* of bell mouth 5 is relatively great on the air inlet 8 side in the centrifugal blower. Spiral casing increased portion 11 is placed such that an area of air duct 21 of spiral casing 7 in a plane including rotational axis X always increases in the direction of rotation of centrifugal fan 3 in spiral casing increased portion 11. In a portion of bell mouth 5 which is continuous with surface 5*b*, non-increased portions 31 are formed in facing side walls 7*c* and 7*e* of spiral casing 7. A distance L4 between non-increased portions 31 of side walls 7*c* and 7*e* is relatively smaller than distance L3 between spiral casing increased portions 11. In side walls 7*c* and 7*e*, a connecting portion between spiral casing increased portion 11 and non-increased portion 31 may have a step shape as shown, in FIG. 9, which may have a smoothly curved shape.

<Function and Effect of Centrifugal Blower of Indoor Unit>

In the centrifugal blower, spiral casing 7 includes a second wall (side wall 7*e*) facing a first wall (side wall 7*c*) with centrifugal fan 3 therebetween in the rotational axis X direction. Side wall 7*c* includes a first outer peripheral portion (spiral casing increased portion 11) connected to a first region (a portion including surface 5*c* with a relatively small curvature in bell mouth 5) in the radial direction of rotational axis X, and a second outer peripheral portion (non-increased portion 31) connected to a second region (a portion including surface 5*b* with a relatively large curvature in bell mouth 5). In the direction extending along rotational axis X, distance L3 between the first outer peripheral portion (spiral casing increased portion 11 of side wall 7*c*) and side wall 7*e* is greater than distance L4 between the second outer peripheral portion (non-increased portion 31 of side wall 7*c*) and side wall 7*e*.

In the configuration shown in FIGS. 8 and 9, the curvature of surface 5*c* in the cross section of bell mouth 5 is reduced in a range in which distance L2 from rotational axis X to downstream end 5*a* of bell mouth 5 (see FIG. 5) is increased, thus maintaining the area of air duct 21 in spiral casing 7. In contrast, an excessively reduced curvature of surface 5*c* in the cross section of bell mouth 5 leads to an excessively increased maximum width (a maximum height from main plate 3*a*) in the rotational axis X direction of spiral casing 7. In this case, the distance between the wall surface of housing 1 and spiral casing 7 or the distance between adjacent spiral casings 7 is relatively small. This results in a reduced air duct sectional area and an increased ventilation resistance in housing 1.

Thus, providing spiral casing increased portion 11 as described above can reduce an extent to which the sectional area of air duct 21 in spiral casing 7 is increased and the curvature of surface 5*c* in the cross section of bell mouth 5 is reduced. Also, spiral casing increased portion 11 is provided such that the sectional area of air duct 21 in spiral casing 7 is always increased in the direction of rotation of centrifugal fan 3, thus suppressing an increase in losses due to an abrupt increase in wind speed.

The centrifugal blower and the air conditioner according to this embodiment which are configured as described above can suppress an increase in the ventilation resistance of the air duct in housing 1 and increase efficiency and reduce noise in the centrifugal blower and the air conditioner, in addition to the effects achieved by the centrifugal blower and the air conditioner according to Embodiment 1.

Embodiment 3

<Configuration of Indoor Unit of Air Conditioner According to This Embodiment>

Figure 10:
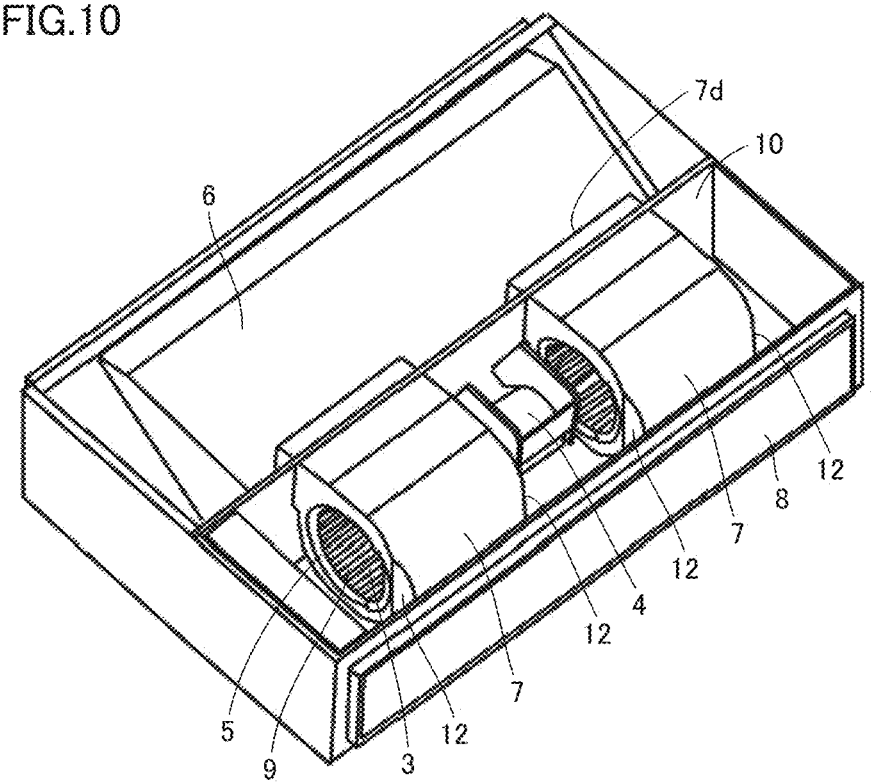
FIG. 10 is a schematic perspective view showing an internal configuration of an air conditioner according to Embodiment 3 of the present invention.
Figure 11:
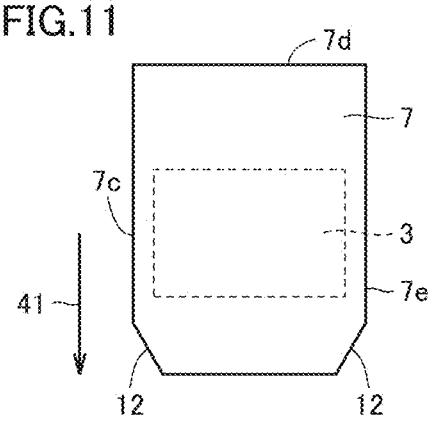
FIG. 11 is a schematic plan view of a centrifugal blower of the air conditioner shown in FIG. 10.

FIG. 10 is a schematic perspective view showing art internal configuration of an air conditioner according to Embodiment 3 of the present invention. FIG. 11 is a planar schematic view of a centrifugal blower of the air conditioner shown in FIG. 10.

The air conditioner shown in FIGS. 10 and 11 basically has a configuration similar to that of the air conditioner shown in FIGS. 1 to 5 but differs from the air conditioner shown in FIGS. 1 to 5 in the configuration of spiral casing 7 in the centrifugal blower. That is to say, in the centrifugal blower according to this embodiment, spiral casing 7 is configured such that the width between facing side walls 7*c* and 7*e* of spiral casing 7 decreases toward air inlet 8 on the air inlet 8 side with respect to bell mouth 5. Specifically, spiral casing decreased portions 12 extending to be declined toward air inlet 8 indicated by an arrow 41 of FIG. 11 are formed in side walls 7*c* and 7*e* of spiral casing 7. When the sectional area of air duct 21 in spiral casing 7 decreases by providing spiral casing decreased portions 12, the sectional area of air duct 21 may be secured by increasing the distance between peripheral wall 7*a* (see FIGS. 3 to 5) and rotational axis X or increasing the distance between side walls 7*c* and 7*e* (see FIG. 9).

<Function and Effect of Centrifugal Blower of Indoor Unit>

In the above centrifugal blower, spiral casing 7 includes the second wall (side wall 7*e*) facing the first wall (side wall 7*c*) with centrifugal fan 3 therebetween in the rotational axis X direction. The first wall (side wall 7*c*) includes the first outer peripheral portion connected to the first region (the portion including surface 5*c* having a relatively small curvature in bell mouth 5) and the second outer peripheral portion connected to the second region (the portion including surface 5*b* having a relatively great curvature in bell mouth 5) in the radial direction of rotational axis X. At least a part of at least one of the first outer peripheral portion and the second wall (in this embodiment, spiral casing decreased portions 12 formed in the first outer peripheral portion) is configured such that the distance between the first outer peripheral portion and the second wall (side wall 7*e*) gradually decreases as apart from rotational axis X in the direction extending along rotational axis X.

Providing spiral casing decreased portions 12 in spiral casing 7 toward air inlet 8 can reduce a ratio of the volume taken up by spiral casing 7 in the region adjacent to air inlet 8. This increases an effective area of the suction air duct in air inlet 8, thus reducing a ventilation resistance in air inlet 8. Such a reduction in ventilation resistance increases the volume of air taken into housing 1, allowing a flow rate of the air introduced into centrifugal blower to be achieved sufficiently. Thus, a flow of air is easily distributed on the vane leading edge of the centrifugal fan in the centrifugal blower, making a wind speed uniform further on the vane leading edge.

As described above, the centrifugal blower and the air conditioner according to this embodiment can reduce a ventilation resistance of the air duct in housing 1 of the air conditioner, in addition to the effects achieved by the centrifugal blower and the air conditioner according to Embodiments 1 and 2 described above. This leads to increased efficiency and reduced noise of the centrifugal blower and the air conditioner.

Embodiment 4

<Configuration, Function and Effect of Indoor Unit of Air Conditioner According to This Embodiment>

Figure 12:
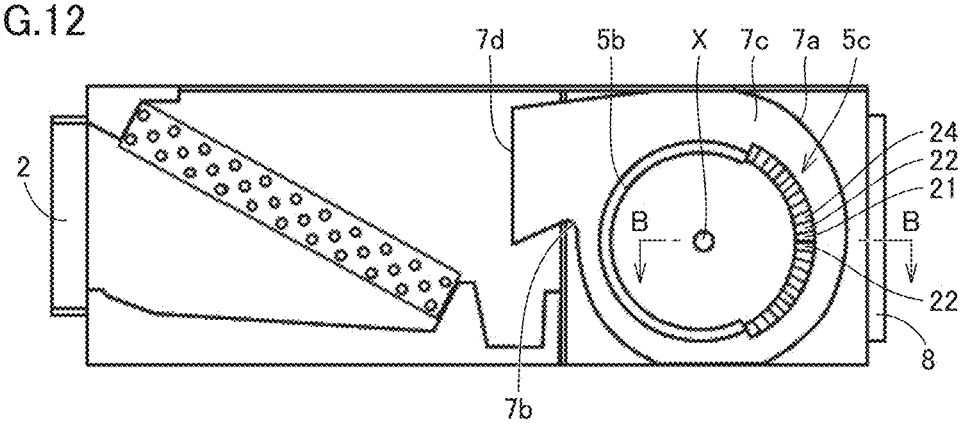
FIG. 12 is a schematic view showing an internal configuration of an air conditioner according to Embodiment 4 of the present invention, which is seen from a side surface of the air conditioner.
Figure 13:
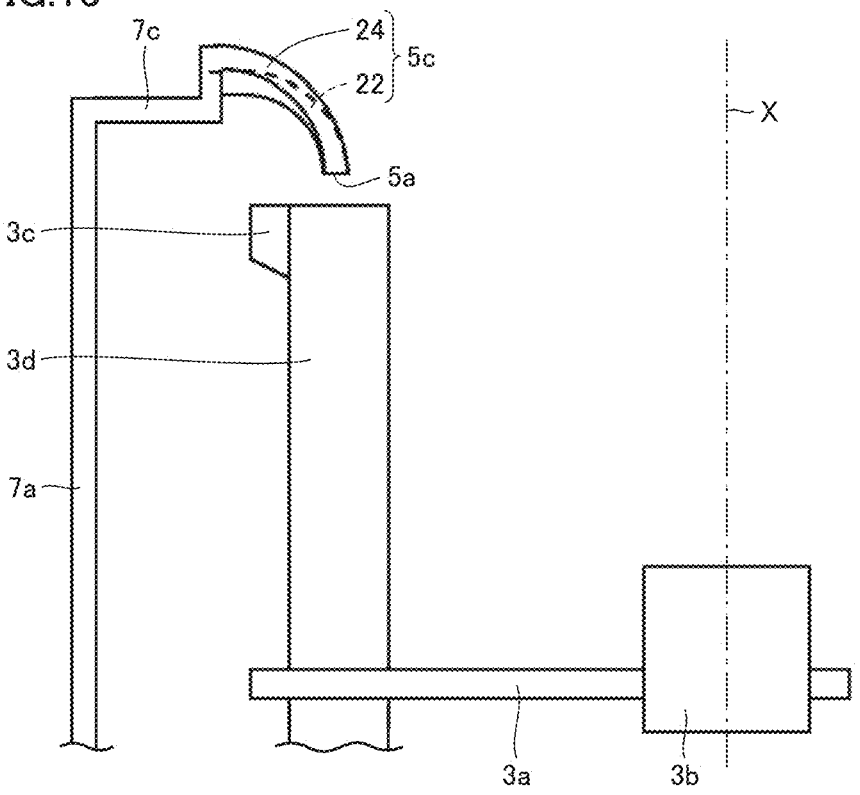
FIG. 13 is a partial schematic sectional view taken along the line segment B-B of FIG. 12.

FIG. 12 is a schematic view showing an internal configuration of an air conditioner according to Embodiment 4 of the present invention, which is seen from a side surface of the air conditioner. FIG. 13 is a partial schematic sectional view taken along the line segment B-B of FIG. 12.

The air conditioner shown in FIGS. 12 and 13 basically has a configuration similar to that of the air conditioner shown in FIGS. 1 to 5 but differs from the air conditioner shown in FIGS. 1 to 5 in the configuration of bell mouth 5 of spiral casing 7 in the centrifugal blower. That is to say, in the air conditioner shown in FIGS. 12 and 13, a turbulent flow accelerating portion is provided on surface 5*c* of bell mouth 5 in a range in which distance L2 from rotational axis X to downstream end 5*a* of bell mouth 5 is increased relatively.

The turbulent flow accelerating portion is a plurality of regions 22 and 24 having different curvatures which are provided in surface 5*c* of bell mouth 5 as shown in FIGS. 12 and 13. For example, in the cross section in a plane including rotational axis X, the curvature of region 24 of surface 5*c* is made relatively small, and the curvature of region 22 of surface 5*c* is made relatively great. Regions 22 and 24 may be provided alternately in the circumferential direction of bell mouth 5. From a different perspective, surface 5*c* of the first region of bell mouth 5 includes first surface portions (regions 24) each having a first curvature and a plurality of second surface portions (regions 22) each having a curvature different from the first curvature. The first surface portions (regions 24) and the second surface portions (regions 22) are arranged alternately along the outer perimeter of the opening defined by bell mouth 5.

Regions 22 and 24 provided alternately in the circumferential direction lead to a nonuniform direction of an airflow when an airflow flows into bell mouth 5, causing the airflow to be easily disturbed near surface 5*c*. The disturbed airflow can delay airflow separation on surface 5*c* of bell mouth 5. This makes wind speed distribution uniform on the vane leading edge of centrifugal fan 3, leading to increased efficiency and reduced noise of the centrifugal blower and the air conditioner.

The area of region 22 and the area of region 24 may be identical to or different from each other. Although two types of regions 22 and 24 having different curvatures are disposed as the turbulent flow accelerating portion in the above example, three types of regions having different curvatures may be disposed in surface 5*c*.

<Configuration, Function and Effect of Indoor Unit of Air Conditioner According to Modification of This Embodiment>

Figure 14:
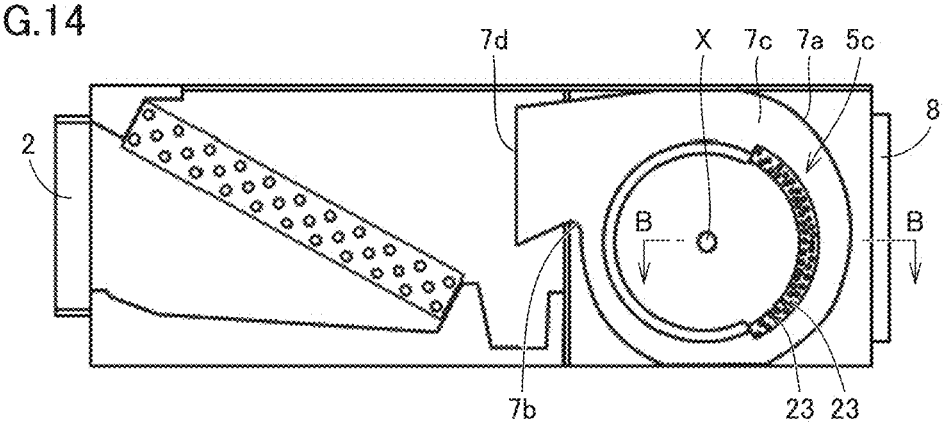
FIG. 14 is a schematic view showing an internal configuration of an air conditioner according to a modification of Embodiment 4 of the present invention, which is seen from a side surface of the air conditioner.
Figure 15:
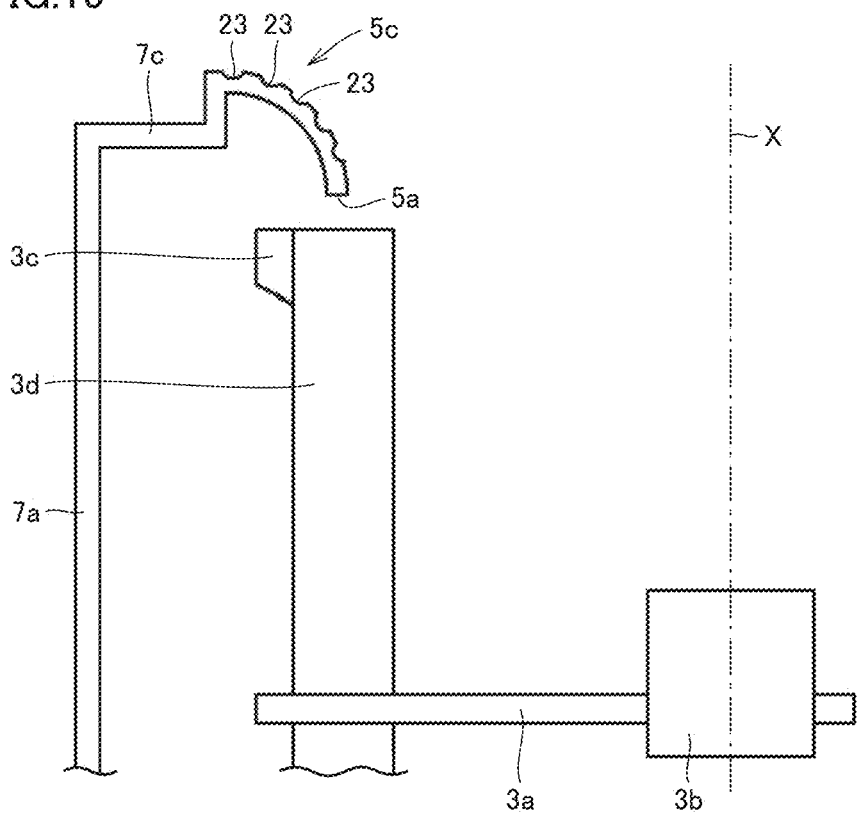
FIG. 15 is a partial schematic sectional view taken along the line segment B-B of FIG. 14.

FIG. 14 is a schematic view showing an internal configuration of an air conditioner according to a modification of Embodiment 4 of the present invention, which is seen from a side surface of the air conditioner. FIG. 15 is a partial schematic sectional view taken along the line segment B-B of FIG. 14.

The air conditioner shown in FIGS. 14 and 15 basically has a configuration similar to that of the air conditioner shown in FIGS. 12 and 13 but differs from the air conditioner shown in FIGS. 12 and 13 in the configuration of the turbulent flow accelerating portion. That is to say, in the air conditioner shown in FIGS. 14 and 15, a plurality of dimples (indentations 23) are formed in surface 5*c* of first region 5*c* of bell mouth 5 as the turbulent flow accelerating portion. Indentations 23 are arranged dispersedly in surface 5*c*. Also such a configuration can lead to increased efficiency and reduced noise of the centrifugal blower and the air conditioner, similarly to the configuration shown in FIGS. 12 and 13.

The planar shape of indentation 23 may be any shape, such as a circular shape or polygonal shape. Although the size of the planar shape of indentation 23 may be common to indentations 23, indentations 23 may include a plurality of types of indentations having different sizes.

Embodiment 5

Figure 16:
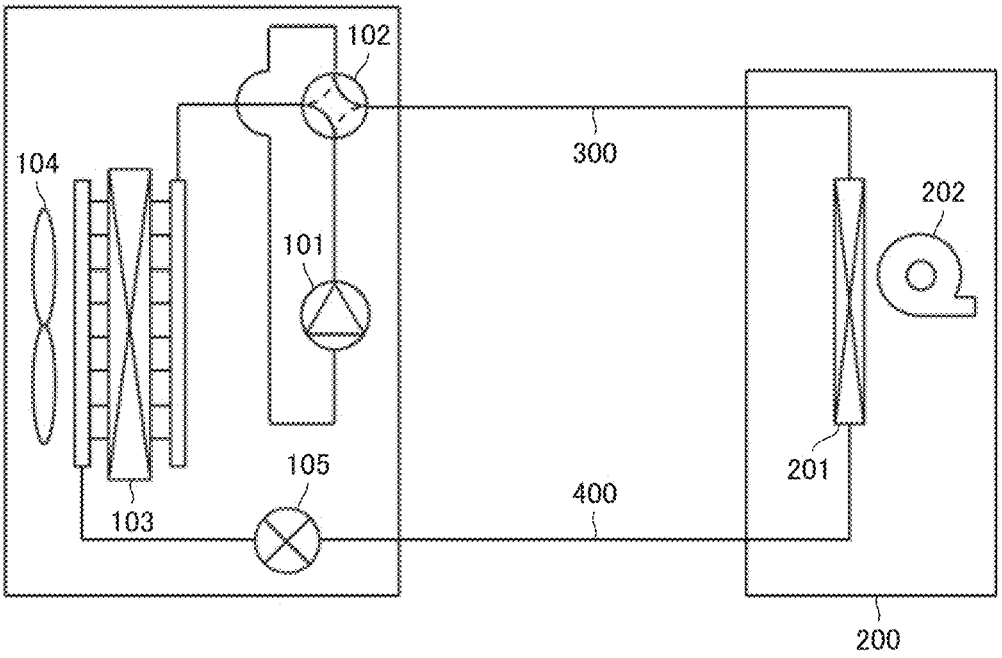
FIG. 16 shows a configuration of an air conditioner according to Embodiment 5 of the present invention.

FIG. 16 shows the configuration of an air conditioner according to Embodiment 5 of the present invention. The present embodiment will describe an air conditioner serving as a refrigeration cycle apparatus having an indoor unit 200 including the centrifugal blower described above and the like. The air conditioner shown in FIG. 16 includes an outdoor unit 100 and indoor unit 200. Outdoor unit 100 and indoor unit 200 are coupled to each other by a refrigerant pipe to constitute a refrigerant circuit. Refrigerant is circulated in the refrigerant circuit. The pipe of the refrigerant pipe through which gaseous refrigerant (gas refrigerant) flows is referred to as a gas pipe 300. A pipe through which refrigerant (including a case of liquid refrigerant or gas-liquid two-phase state refrigerant) flows is referred to as a liquid pipe 400.

Outdoor unit 100 includes a compressor 101, a four-way valve 102, an outdoor-unit-side heat exchanger 103, an outdoor-unit-side blower 104, and a throttle device (expansion valve) 105 in this embodiment.

Compressor 101 compresses taken-in refrigerant and discharges the compressed refrigerant. Herein, compressor 101 includes an inverter device or the like and can appropriately change an operation frequency to finely change the capacity (an amount of refrigerant fed per unit time) of compressor 101. Four-way valve 102 switches a flow path for refrigerant between during cooling operation and during heating operation based on an instruction from a controller (not shown).

Outdoor-unit-side heat exchanger 103 performs heat exchange between refrigerant and air (outside air). For example, outdoor-unit-side heat exchanger 103 functions as an evaporator during heating operation and performs heat exchange between air and low-pressure refrigerant flowing from liquid pipe 400. In this case, outdoor-unit-side heat exchanger 103 evaporates and vaporizes the refrigerant. Outdoor-unit-side heat exchanger 103 functions as a condenser during cooling operation. In this case, the refrigerant compressed in compressor 101 flows into outdoor-unit-side heat exchanger 103 from the four-way valve 102 side. Outdoor-unit-side heat exchanger 103 performs heat exchange between refrigerant and air, and condenses and liquefies the refrigerant. For efficient heat exchange between refrigerant and air, outdoor-unit-side heat exchanger 103 is provided with outdoor-unit-side blower 104 that is the centrifugal blower described in Embodiments 1 to 4. Outdoor-unit-side blower 104 may appropriately change the operation frequency of the fan motor by the inverter device to finely change the rotation speed of centrifugal fan 3 serving as a blower fan. Throttle device 105 is provided to adjust a pressure or the like of the refrigerant by changing a degree of opening.

In contrast, indoor unit 200 is composed of a negative-side heat exchanger 201 and a negative-side blower 202. Negative-side heat exchanger 201 performs heat exchange between refrigerant and air. For example, negative-side heat exchanger 201 functions as a condenser during heating operation. In this case, negative-side heat exchanger 201 performs heat exchange between air and refrigerant flowing from gas pipe 300, and condenses and liquefies the refrigerant (or turns the refrigerant into gas-liquid two-phase state). Consequently, the liquefied refrigerant flows out from negative-side heat exchanger 201 toward liquid pipe 400. In contrast, negative-side heat exchanger 201 functions as an evaporator during cooling operation. For example, negative-side heat exchanger 201 performs heal exchange between air and the refrigerant whose pressure has been reduced by throttle device 105. In this case, negative-side heat exchanger 201 causes the refrigerant to take the heat of the air away, thereby gasifying the refrigerant. The gasified refrigerant flows out from negative-side heat exchanger 201 toward gas pipe 300. Also, indoor unit 200 is provided with a negative-side blower 202 for adjusting a flow of air for heat exchange. The operation speed of negative-side blower 202 is determined by, for example, user's setting. The centrifugal blower described in Embodiments 1 to 4 can be used in negative-side blower 202, which is not particularly limited.

The air conditioner of Embodiment 5 uses the centrifugal blower described in Embodiments 1 to 4 in outdoor unit 100 and further in indoor unit 200 as described above, leading to, for example, increased efficiency and reduced noise.

Although the present invention has been described specifically by way of the preferable embodiments, the person skilled in the art can obviously adopt various modifications based on the basic technical ideas and teachings of the present invention. For example, as a usage example of the present invention, the indoor unit of the refrigeration cycle apparatus, for example, the indoor unit of the air conditioner can naturally be used in various types of apparatus or equipment in which the centrifugal blower is installed.

Although the embodiments of the present invention have been described above, the embodiments can be modified variously. Also, the scope of the present invention is not limited to the above embodiments. It is therefore intended that the scope of the present invention is defined by claims, not only by the embodiments described above, and encompasses all modifications and variations equivalent in meaning and scope to the claims.

INDUSTRIAL APPLICABILITY

The present invention is particularly advantageously applied to a centrifugal blower placed in, for example, an indoor unit of an air conditioner.

REFERENCE SIGNS LIST

1 housing, 1*a* upper surface portion, 1*b* lower surface portion, 1*c* side surface portion, 2 air outlet, 3 centrifugal fan, 3*a* main plate, 3*b* boss, 3*c* side plate, 3*d* vane, 4 fan motor, 5 bell mouth, 5*a* downstream end, 5*b*, 5*c* surface, 6 heat exchanger, 7 spiral casing, 7*a* peripheral wall, 7*b* tongue, 7*c*, 7*e* side wall, 7*d* outlet, 8 air inlet, 9 suction port, 10 partition plate, 11 spiral casing increased portion, 12 spiral casing decreased portion, 21 air duct, 22, 24 region, 23 indentation, 31 non-increased portion, 41 arrow, 100 outdoor unit, 101 compressor, 102 four-way valve, 103 outdoor-unit-side heat exchanger, 104 outdoor-unit-side blower, 105 throttle device, 200 indoor unit, 201 negative-side heat exchanger, 202 negative-side blower, 300 gas pipe, 400 liquid pipe.

The invention claimed is:

1. An air conditioner comprising:

a housing having a first side surface and a second side surface opposite to the first side surface;

a heat exchanger disposed in the housing; and a centrifugal blower disposed in the housing, wherein the housing has an air outlet formed in the first side surface, the housing has an air inlet formed in the second side surface, in the housing, the heat exchanger is closer to the air outlet than the centrifugal blower is to the air outlet, the centrifugal blower comprises a casing and a centrifugal fan housed in the casing, the casing has an outlet formed in a radial direction perpendicular to a rotational axis of the centrifugal fan, the outlet of the casing is formed on an opposite side of the rotational axis from the air inlet, the casing has a first wall facing the centrifugal fan, the first wall has an opening for taking in air, the opening being formed in a portion of the first wall, the portion being crossed by the rotational axis of the centrifugal fan, the first wall has a bell mouth surrounding the opening, the bell mouth has a first region and a second region, the first region is closer to the air inlet than any other part of the bell mouth, and the second region is close to the outlet and is facing the outlet, the second region is on an opposite side of the rotational axis from the first region, the bell mouth comprises in each of the first region and the second region, an end defining an outer perimeter of the opening, and a surface that is curved and extends from the end to be away from the centrifugal fan, a distance from the rotational axis of the centrifugal fan to the end in the first region is greater than a distance from the rotational axis to the end in the second region, a curvature of the surface of the first region in a cross section of the first region that includes the rotational axis is smaller than a curvature of the surface of the second region in a cross section of the second region that includes the rotational axis, and the first wall of the centrifugal blower extends from the air inlet to the air outlet.

2. The air conditioner according to claim 1, wherein the casing has a second wall facing the first wall with the centrifugal fan therebetween in a direction of the rotational axis, the first wall has in a radial direction of the rotational axis a first outer peripheral portion connected to the first region, and a second outer peripheral portion connected to the second region, and in a direction extending along the rotational axis, a distance between the first outer peripheral portion and the second wall is greater than a distance between the second outer peripheral portion and the second wall.

3. The air conditioner according to claim 1, wherein in the casing, a space between an inner surface of the casing located outside the centrifugal fan in the radial direction and the centrifugal fan is an air duct, and a sectional area of the air duct in a cross section including the rotational axis increases from the tongue in the direction of rotation.

4. The air conditioner according to claim 1, wherein the casing has a second wall facing the first wall with the centrifugal fan therebetween in a direction of the rotational axis, the first wall has in a radial direction of the rotational axis a first outer peripheral portion connected to the first region, and a second outer peripheral portion connected to the second region, and at least a part of at least one of the first outer peripheral portion and the second wall is formed such that a distance between the first outer peripheral portion and the second wall becomes gradually smaller in a direction extending along the rotational axis.

5. The air conditioner according to claim 1, wherein the surface of the first region of the bell mouth has a plurality of first front portions each having a first curvature, and a plurality of second front portions each having a curvature different from the first curvature, and the plurality of first front portions and the plurality of second front portions are arranged alternately along an outer perimeter of the opening.

6. The air conditioner according to claim 1, wherein the surface of the first region of the bell mouth has a plurality of recesses.

7. The air conditioner according to claim 1, wherein a radius of the first region from the rotation axis is uniform.

8. The air conditioner according to claim 1, wherein a radius of the second region from the rotation axis is uniform.

9. The air conditioner according to claim 1, wherein a radius of the first region from the rotation axis and a radius of the second region from the rotation axis are uniform.

* * * * *